US011291323B2

(12) United States Patent
Wipf

(10) Patent No.: US 11,291,323 B2
(45) Date of Patent: Apr. 5, 2022

(54) CARPET STRETCHING APPARATUS

(71) Applicant: Tom Wipf, Crooks, SD (US)

(72) Inventor: Tom Wipf, Crooks, SD (US)

( * ) Notice: Subject to any disclaimer, the term of this patent is extended or adjusted under 35 U.S.C. 154(b) by 53 days.

(21) Appl. No.: 16/703,971

(22) Filed: Dec. 5, 2019

(65) Prior Publication Data

US 2021/0169258 A1 Jun. 10, 2021

(51) Int. Cl.
*A47G 27/04* (2006.01)

(52) U.S. Cl.
CPC ..... *A47G 27/0493* (2013.01)

(58) Field of Classification Search
CPC ..... A47G 27/04; A47G 27/0493
See application file for complete search history.

(56) References Cited

U.S. PATENT DOCUMENTS

| | | | | | |
|---|---|---|---|---|---|
| 717,829 | A * | 1/1903 | Fehrmann | A47G 27/0493 | 254/206 |
| 3,747,157 | A | 7/1973 | Szymanski | | |
| 3,751,440 | A | 8/1973 | Ream | | |
| 3,752,440 | A * | 8/1973 | Ream | A47G 27/0493 | 254/209 |
| 4,076,213 | A * | 2/1978 | Payson | A47G 27/0493 | 254/210 |
| 4,934,658 | A * | 6/1990 | Berg | A47G 27/0493 | 248/408 |
| 5,176,387 | A | 1/1993 | Taggart | | |
| 5,364,143 | A | 11/1994 | Grady | | |
| 5,472,170 | A | 12/1995 | Anasson | | |
| 5,484,136 | A | 1/1996 | Lopes | | |
| 7,114,704 | B1 * | 10/2006 | Suckow | A47G 27/0493 | 254/209 |
| 7,163,196 | B2 | 1/2007 | Behr | | |
| 7,451,961 | B2 | 11/2008 | Kirker | | |
| 7,722,012 | B2 | 5/2010 | Kirker | | |
| 8,757,595 | B2 | 6/2014 | Garzanelli | | |
| 9,833,096 | B2 | 12/2017 | Sorbin | | |
| 2009/0095943 | A1 * | 4/2009 | Thompson | A47G 27/0493 | 254/212 |

* cited by examiner

*Primary Examiner* — Sang K Kim
*Assistant Examiner* — Nathaniel L Adams

(57) ABSTRACT

A carpet stretching apparatus includes a sleeve that has a first end and a second end. The first end is open. A carpet stretcher extends outwardly of the first end and is rotatable with respect to the sleeve. A locking member releasably engages the sleeve to the carpet stretcher in a first position or a second position. The first and second positions are orientated 90° with respect to each other. An anchor is attached to the second end of the sleeve and releasably engages the carpet.

6 Claims, 6 Drawing Sheets

CARPET STRETCHING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to carpet stretching device and more particularly pertains to a new carpet stretching device for which allows a person alter the orientation of different sections of the device such that it is easier to transport and to move through narrow openings, such as doorways. The device further includes a unique handle which aids in controlling the positioning of the device.

(2) Description of Related Art Including Information Disclosed Under 37 CFR 1.97 and 1.98

The prior art relates to carpet stretching devices which are used for extending portions of a carpet to ensure that it is pulled taut before securing it in place.

BRIEF SUMMARY OF THE INVENTION

An embodiment of the disclosure meets the needs presented above by generally comprising a sleeve that has a first end and a second end. The first end is open. A carpet stretcher extends outwardly of the first end and is rotatable with respect to the sleeve. A locking member releasably engages the sleeve to the carpet stretcher in a first position or a second position. The first and second positions are orientated 90° with respect to each other. An anchor is attached to the second end of the sleeve and releasably engages the carpet.

In another embodiment the disclosure comprises a sleeve has a first end and a second end, wherein the first end is open. A carpet stretcher extends outwardly of the first end. An anchor is attached to the second end of the sleeve and is configured to releasably engage the carpet. A handle is attached to the anchor and extends upwardly therefrom.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
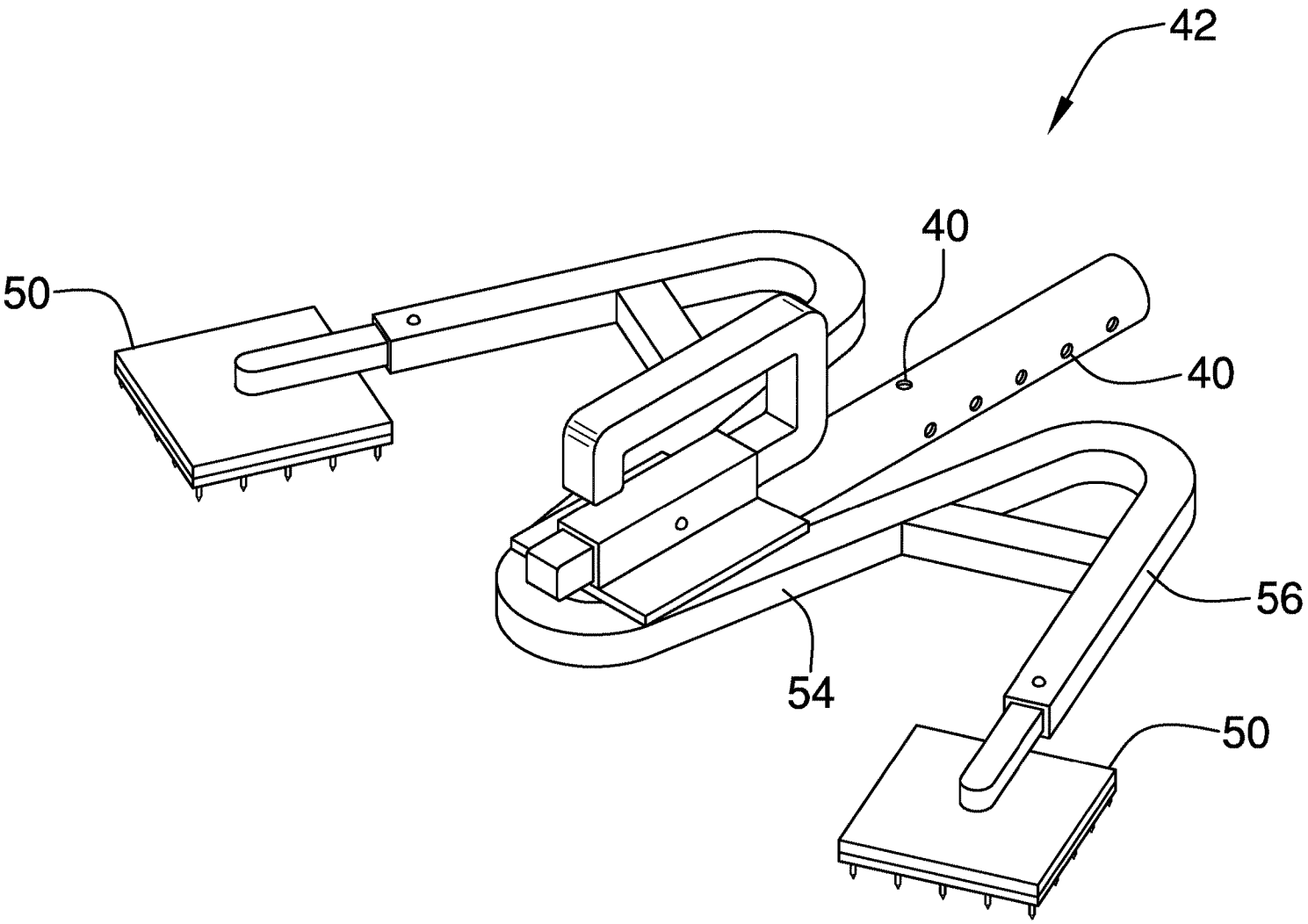
FIG. 1 is a top isometric view of a carpet stretching apparatus according to an embodiment of the disclosure.

With reference now to the drawings, and in particular to FIGS. 1 through 6 thereof, a new carpet stretching device embodying the principles and concepts of an embodiment of the disclosure and generally designated by the reference numeral 10 will be described.

As best illustrated in FIGS. 1 through 6, the carpet stretching apparatus 10 generally comprises a sleeve 12 that has a first end 14 and a second end 16 wherein the first end 14 is open. A carpet stretcher 20 extends outwardly of the first end 14. The carpet stretcher 20 is rotatable with respect to the sleeve.

The carpet stretcher 20 includes a rod 22 that is elongated and extends into first end 14. The rod 22 has a longitudinal axis that is co-axial with a longitudinal axis of the sleeve 12. The rod 22 is rotatable about its longitudinal axis and the longitudinal axis of the sleeve 12. A piston 24 extends outwardly from the rod 22 opposite of the sleeve 12. A plate 26 is attached to the piston 24 and a plurality of gripping pins 28 is attached to and extends downwardly from the plate 26. The gripping pins 28 may be straight or may be curved or angled rearwardly toward the rod 22. The gripping pins 28 and are configured to releasably engage carpet. An actuator 30 is pivotally coupled to the piston 24 or plate 26. An arm 32 has an outer end 34 pivotally coupled to the actuator 30 and an inner end 36 pivotally coupled to the rod 22. The actuator 30, which may comprise an elongated lever, has a free end 38 that is actuated toward the rod 22 to urge the piston 24 outwardly away from the rod 22. The actuator 30 may include attachments or be telescopic to selectively increase the length of the actuator 30. The carpet stretcher 20 is generally conventional of the type used with various means for anchoring the rod 22 in a static location such that the piston 24 can be biased outwardly while the plate 26 engages the carpet. A hold 37 may be attached to the plate 26 opposite of the gripping pins 28.

Figure 5:
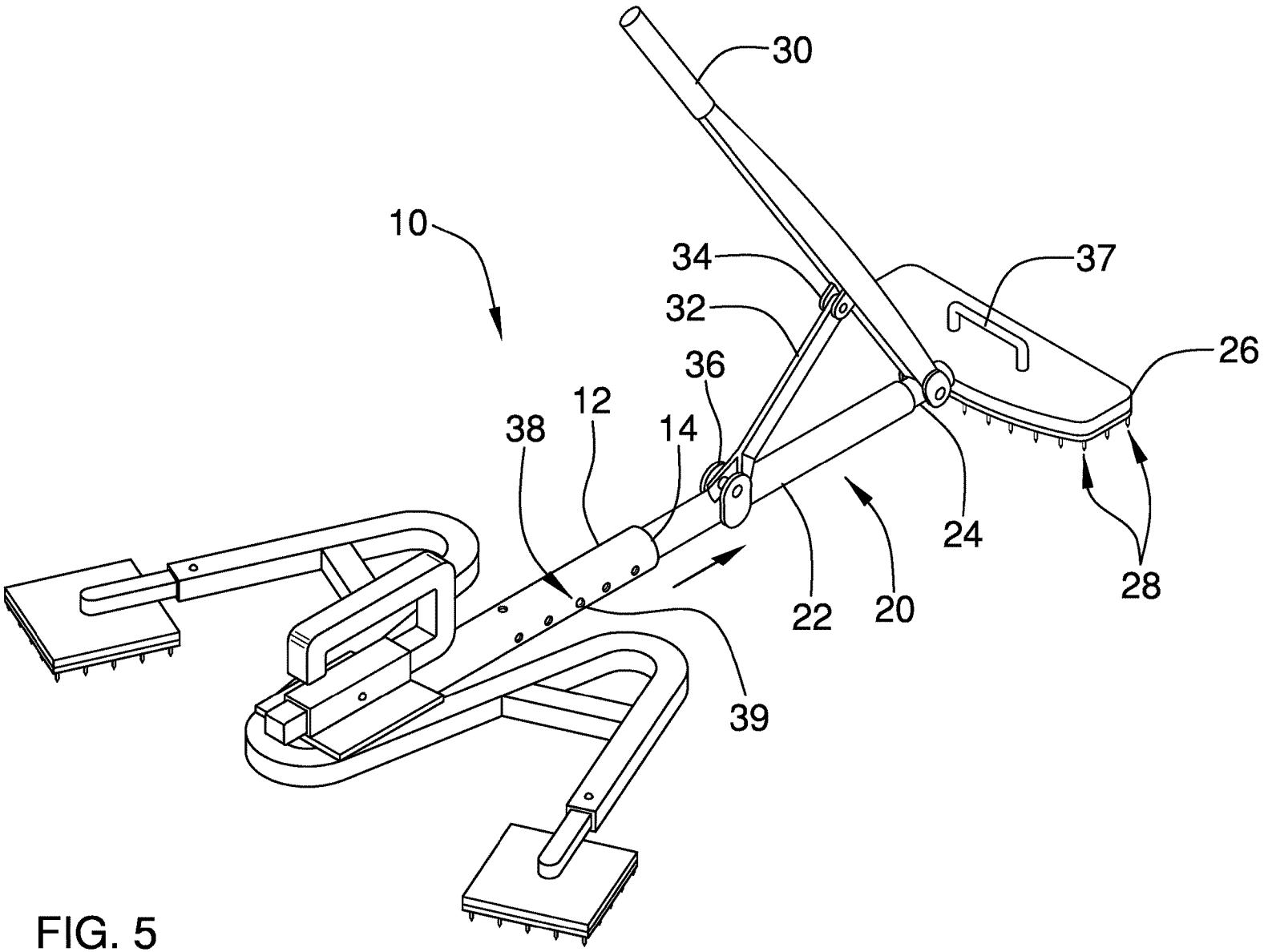
FIG. 5 is a rear isometric view of an embodiment of the disclosure.
Figure 6:
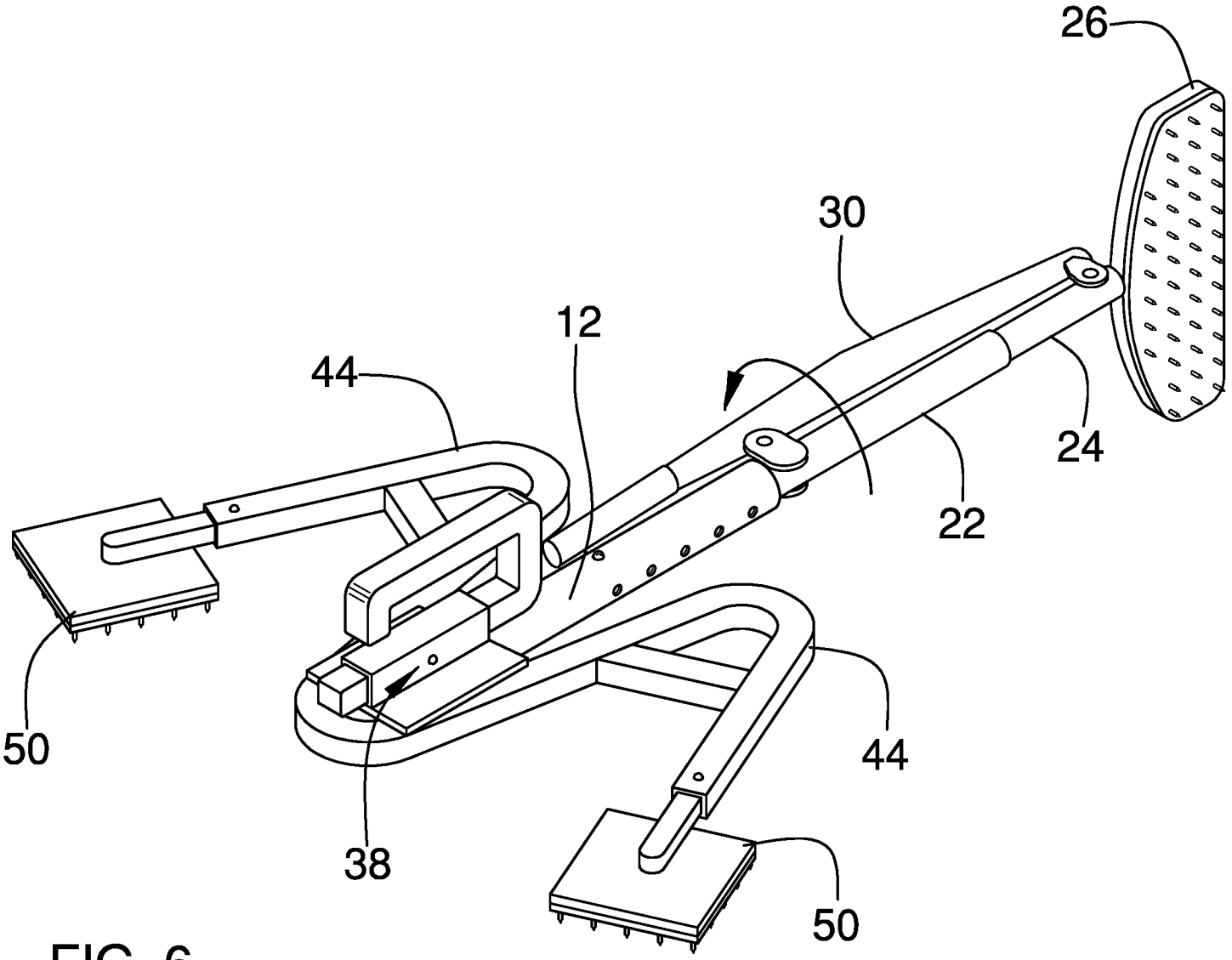
FIG. 6 is a rear isometric view of an embodiment of the disclosure.

A locking member 38 releasably engages the sleeve 12 to the carpet stretcher 20 in a first position as shown in FIG. 5 or a second position as shown in FIG. 6. The first and second positions are orientated 90° with respect to each other. The locking member 38 may include, for example, a detent 39 mounted on the rod 22 and extends through one of a plurality of apertures 40 extending through the cylinder 12. At least one of the apertures 40 has a horizontal axis and at least one of the apertures 40 has a vertical axis. Generally, the first position is defined as an in-use orientation wherein the plate 26 is horizontally orientated as shown in FIG. 5. As can be seen in the Figures, there may include a row of apertures 40 which position the carpet stretcher 20 in the first position such that a combined length of the cylinder 12 and rod 22 may be selectively altered. While the apertures 40 are defined as either horizontal or vertical, it should be understood that their positioning generally requires at least one of the apertures 40 being offset 90° from at least one of the other apertures 40.

Figure 2:
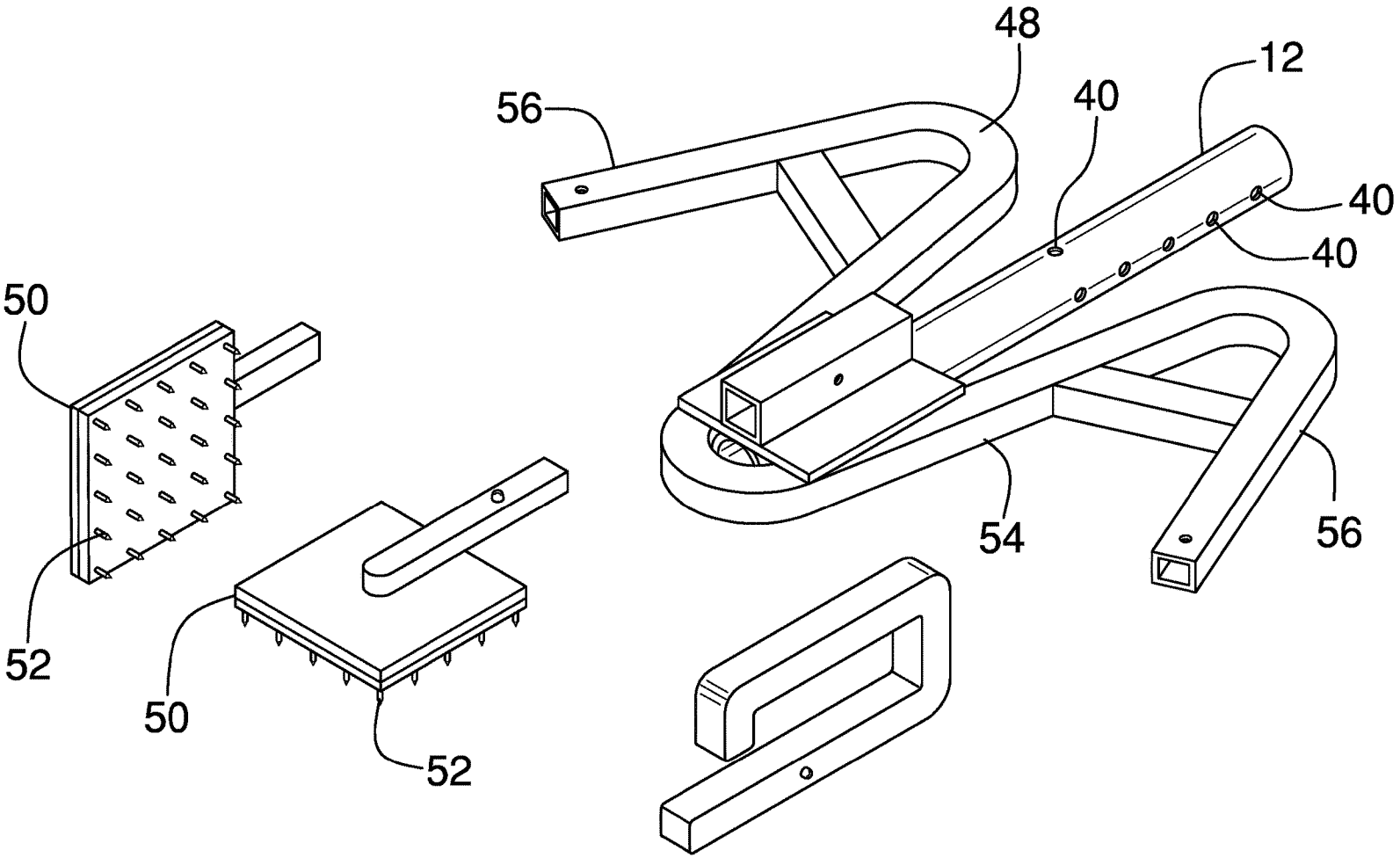
FIG. 2 is a top isometric view of an embodiment of the disclosure.
Figure 3:
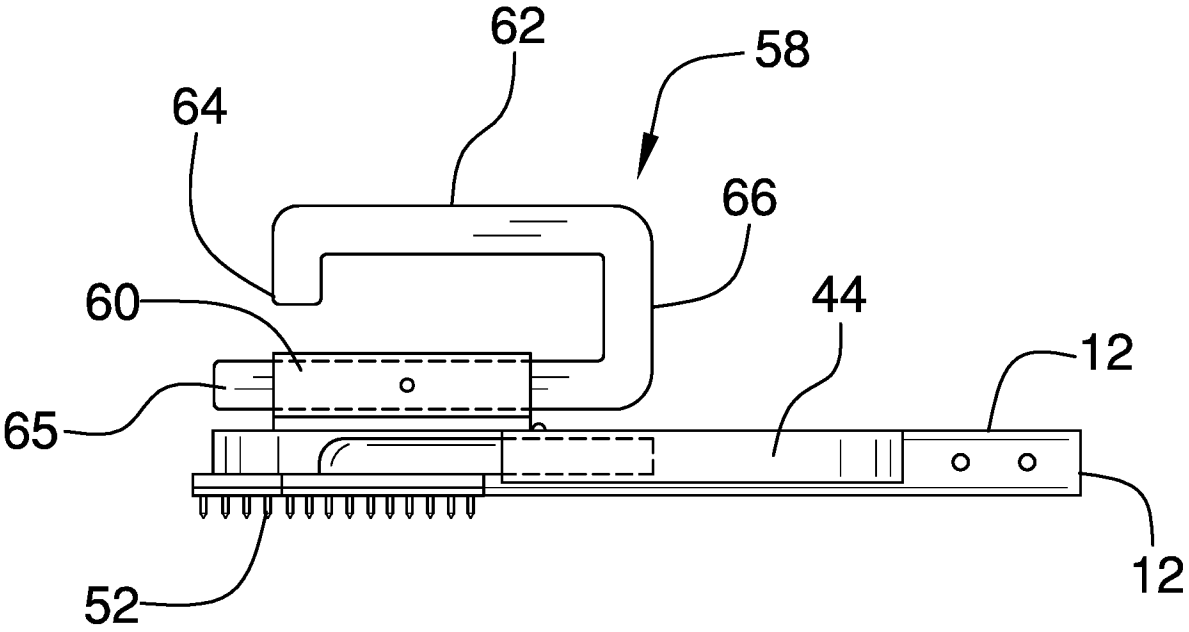
FIG. 3 is a side view of an embodiment of the disclosure.
Figure 4:
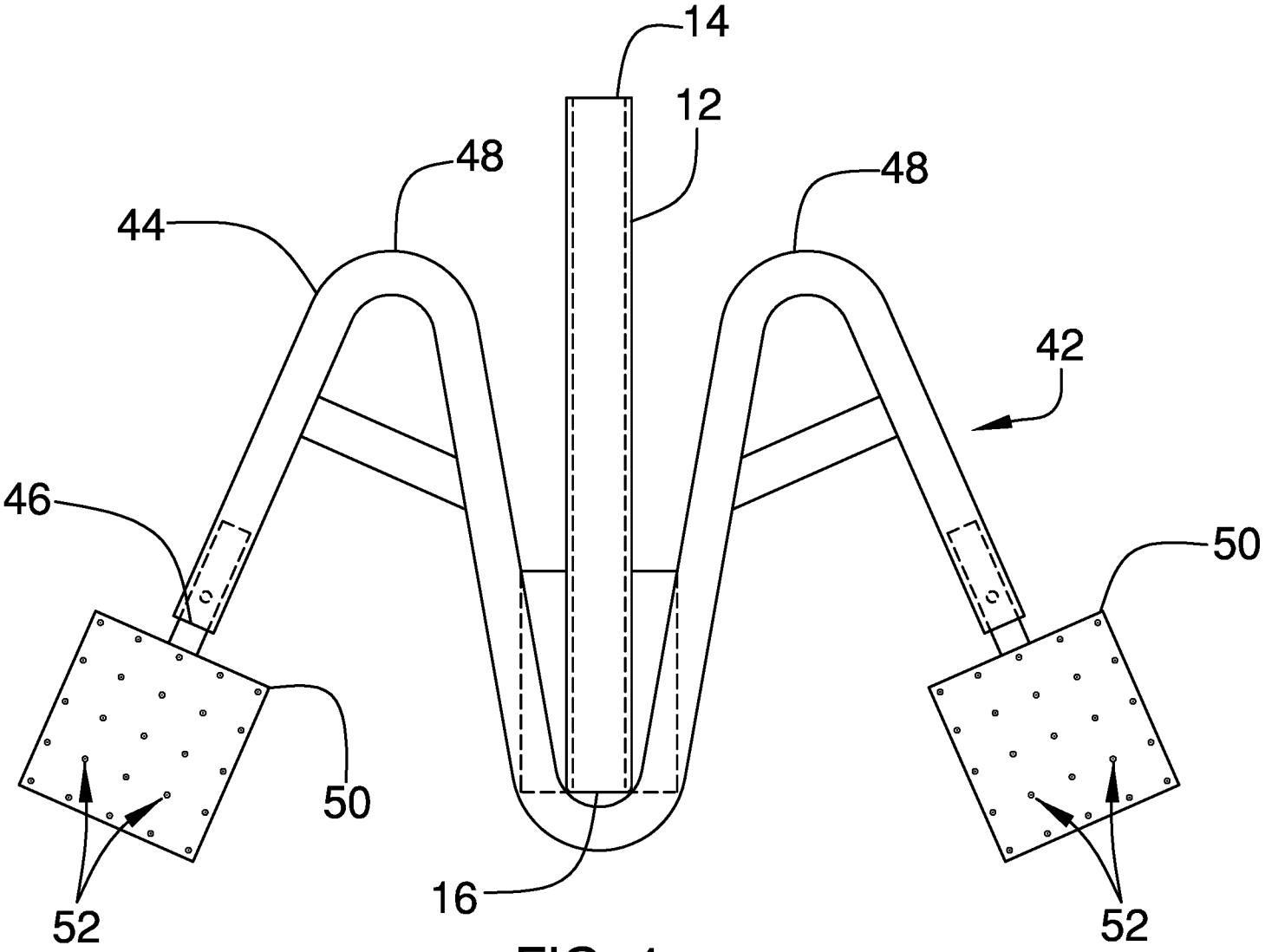
FIG. 4 is a bottom view of an embodiment of the disclosure.

An anchor 42 is attached to the second end 16 of the sleeve 12 and is configured to releasably engage the carpet. The anchor 42 includes a pair of legs 44 attached to the sleeve 12 and positioned on opposite sides of the sleeve 12. Each of the legs 44 has a distal end 46 with respect to the cylinder 12. The legs 44 are U-shaped and include an arcuate central area 48 extending toward the carpet stretcher 20. A pair of panels 50 is provided. Each of the distal ends 46 has one of the panels 50 attached thereto. As can be seen in FIG. 2, the panels 50 may be removable from the legs 44 for storage purposes. The panels 50 may be removably attached to the legs 44 as is shown in FIG. 2. A plurality of gripping pins 52 is attached to and extends downwardly from each of the panels 50. When the cylinder 12 and the rod 22 are in the first position, the gripping pins 52 on the panels 50 and the gripping pins 28 on the plate 26 are each engageable with the carpet. When the cylinder 12 and rod 22 are in the second position, the legs 44 lie in a same plane as the actuator 30 and rod 22. In the second position, the apparatus 10 has a slimmer profile for walking the apparatus 10 through doorways or other narrow spaces. As can be seen in the Figures, the legs 44 each include an inner section 54 and an outer section 56 wherein the outer sections 56 are angled outwardly away from the cylinder 12 to increase a width of the anchor 42.

A handle 58 is removably attached to the anchor 42 and extends upwardly therefrom. The handle 58 includes a receiver 60 that is elongated and is aligned with the longitudinal axis of the cylinder 12. A grip 62 is provided which is elongated and may include a downturned stop 64. An elongated member 65 is removably extendable into the receiver 60. A central member 66 is attached to and extends between the grip 62 and the elongated member 65 such that the grip 62 and the elongated member 65 are orientated parallel to each other. A securing member 66 releasably secures the elongated member 65 in the receiver 60 such that the grip 62 extends either away or toward the carpet stretcher 20. The securing member 62 may include an outwardly biased detent. This allows the handle 58 to be directed in either direction depending on how the handle 58 is being used.

In use, the apparatus 10 is used in a conventional manner wherein the anchor 42 and the plate 26 of the carpet stretcher 20 are both engaged with the carpet. Typically, weight is placed on the anchor 20, such as the weight of the person's body who is operating the apparatus 10. The shape of the legs 44 increases the ability of the user to place their weight on the anchor 42. The actuator 30 is then actuated to force the plate away from the anchor 42, thus stretching the carpet. When moving the apparatus 10, the cylinder 12 and rod 22 are placed in the second position to allow easier transportation of the apparatus 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A carpet installation assembly configured to facilitate carpet stretching, said carpet installation assembly comprising:

a sleeve having a first end and a second end, said first end being open;

a carpet stretcher extending outwardly of said first end, said carpet stretcher being rotatable with respect to said sleeve;

a locking member releasably engaging said sleeve to said carpet stretcher in a first position or a second position, said first and second positions being orientated 90° with respect to each other; and an anchor being attached to said second end of said sleeve and being configured to releasably engage the carpet;

wherein said anchor includes:

a pair of legs being attached to said sleeve and being positioned on opposite sides of said sleeve, each of said legs having a distal end with respect to said sleeve, each of said legs being U-shaped and includes an arcuate central area extending toward said carpet stretcher; and a pair of panels, each of said distal ends having one of said panels attached thereto, a plurality of gripping pins being attached to and extending downwardly from each of said panels.

2. The carpet installation assembly according to claim 1, wherein said carpet stretcher includes:

a rod being elongated and extended into first end, said rod having a longitudinal axis being co-axial with a longitudinal axis of said sleeve, said rod being rotatable about its longitudinal axis;

a piston extending outwardly from said rod opposite of said sleeve;

a plate being attached to said piston, a plurality of gripping pins being attached to and extending downwardly from said plate and being configured to releasably engage carpet;

an actuator being pivotally coupled to said piston;

an arm having an outer end pivotally coupled to said actuator and an inner end pivotally coupled to said rod, said actuator having a free end being actuated toward said rod to urge said piston outwardly away from said rod;

said locking member including a detent mounted on said rod and extending through one of a plurality of apertures extending through said sleeve, at least one of said apertures having a horizontal axis and at least one of said apertures having a vertical axis.

3. The carpet installation assembly according to claim 1, further including a handle being removably attached to said anchor and extending upwardly therefrom.

4. The carpet installation assembly according to claim 1, further comprising:

said carpet stretcher including:

a rod being elongated and extended into first end, said rod having a longitudinal axis being co-axial with a longitudinal axis of said sleeve, said rod being rotatable about its longitudinal axis;

a piston extending outwardly from said rod opposite of said sleeve;

a plate being attached to said piston, a plurality of gripping pins being attached to and extending downwardly from said plate and being configured to releasably engage carpet;

an actuator being pivotally coupled to said piston;

an arm having an outer end pivotally coupled to said actuator and an inner end pivotally coupled to said rod, said actuator having a free end being actuated toward said rod to urge said piston outwardly away from said rod;

said locking member including a detent mounted on said rod and extending through one of a plurality of apertures extending through said sleeve, at least one of said apertures having a horizontal axis and at least one of said apertures having a vertical axis;

a handle being removably attached to said anchor and extending upwardly therefrom, said handle including:

a receiver being elongated and being aligned with said longitudinal axis of said sleeve;

a grip being elongated;

an elongated member being removably extendable into said receiver;

a central member being attached to and extending between said grip and said elongated member such that said grip and said elongated member are orientated parallel to each other; and a securing member releasably securing said elongated member in said receiver such that said grip extends either away or toward said carpet stretcher.

5. A carpet installation assembly configured to facilitate carpet stretching, said carpet installation assembly comprising:

a sleeve having a first end and a second end, said first end being open;

a carpet stretcher extending outwardly of said first end;

an anchor being attached to said second end of said sleeve and being configured to releasably engage the carpet;

a handle being attached to said anchor and extending upwardly therefrom; and wherein said handle includes:

a receiver being elongated and being aligned with said longitudinal axis of said sleeve;

a grip being elongated;

an elongated member being removably extendable into said receiver;

a central member being attached to and extending between said grip and said elongated member such that said grip and said elongated member are orientated parallel to each other; and a securing member releasably securing said elongated member in said receiver such that said grip extends either away or toward said carpet stretcher.

6. A carpet installation assembly configured to facilitate carpet stretching, said carpet installation assembly comprising:

a sleeve having a first end and a second end, said first end being open;

a carpet stretcher extending outwardly of said first end, said carpet stretcher being rotatable with respect to said sleeve;

a locking member releasably engaging said sleeve to said carpet stretcher in a first position or a second position, said first and second positions being orientated 90° with respect to each other;

an anchor being attached to said second end of said sleeve and being configured to releasably engage the carpet; and a handle being removably attached to said anchor and extending upwardly therefrom, wherein said handle includes:

a receiver being elongated and being aligned with said longitudinal axis of said sleeve;

a grip being elongated;

an elongated member being removably extendable into said receiver;

a central member being attached to and extending between said grip and said elongated member that said grip and said elongated member orientated parallel to each other; and a securing member releasably securing said elongated member in said receiver such that said grip extends either away or toward said carpet stretcher.

* * * * *